United States Patent [19]

Cater, Sr.

[11] 4,427,021

[45] Jan. 24, 1984

[54] COLLAPSIBLE TENT STRUCTURE WITH ELEVATED FLOOR

[76] Inventor: Leavie Cater, Sr., 305 W. Polk St., Santa Maria, Calif. 93454

[21] Appl. No.: 420,930

[22] Filed: Sep. 21, 1982

Related U.S. Application Data

[63] Continuation-in-part of Ser. No. 203,274, Nov. 3, 1980, abandoned.

[51] Int. Cl.[3] ..... A45F 1/16

[52] U.S. Cl. ..... 135/109; 5/111; 5/113; 5/117; 5/310; 5/414; 135/116; 135/DIG. 9

[58] Field of Search ..... 5/111, 112, 117, 311, 5/312, 175, 176, 177, 178, 179, 180, 310, 312, 411, 174, 210, 226, 278, 285, 113, 114, 315, 202, 168, 188, 201, 203, 305; 135/104, 105, 102, 96, 109, 116, 905, 1 R

[56] References Cited

U.S. PATENT DOCUMENTS

| | | | |
|---|---|---|---|
| 369,806 | 9/1887 | Nable | 5/315 |
| 1,006,942 | 10/1911 | Hess | 135/96 |
| 1,285,689 | 11/1918 | Handel | 5/202 |
| 1,906,829 | 5/1933 | Wilson | 5/113 |
| 3,371,671 | 5/1968 | Kirkham | 135/104 |
| 3,584,322 | 6/1971 | McDougall | 135/96 |
| 3,757,361 | 9/1973 | Wescott | 5/109 |
| 3,848,279 | 11/1974 | Ipsen, Jr. | 5/109 |
| 4,250,906 | 2/1981 | Bucani et al. | 5/109 |

FOREIGN PATENT DOCUMENTS

| | | | |
|---|---|---|---|
| 702097 | 3/1966 | Italy | 135/104 |
| 28514 | 3/1910 | Sweden | 5/178 |

*Primary Examiner*—Richard C. Pinkham
*Assistant Examiner*—T. Brown

[57] ABSTRACT

A tent structure adapted for use by game hunters, fishermen, etc., comprising a pair of floor-supporting frames hinged to one another on a medial axis for folding together; a foldable linkage for supporting the floor frames in elevated positions above ground moisture; and foldable corner posts and roof frame structure for supporting a canvas covering in an area rising vertically from the floor area.

6 Claims, 11 Drawing Figures

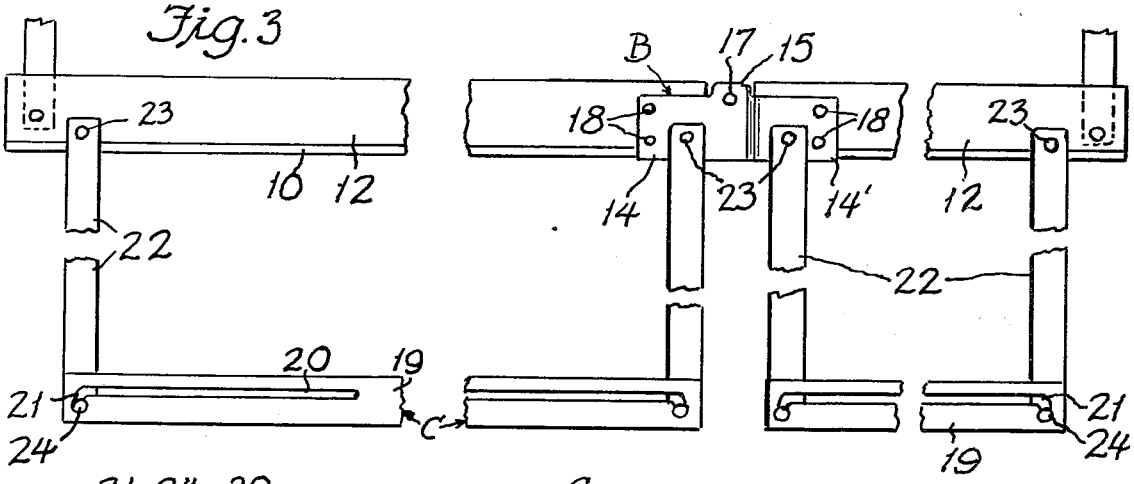
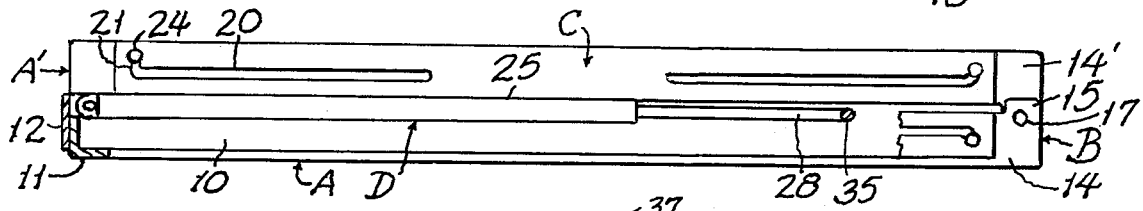
Fig.2
Fig.4
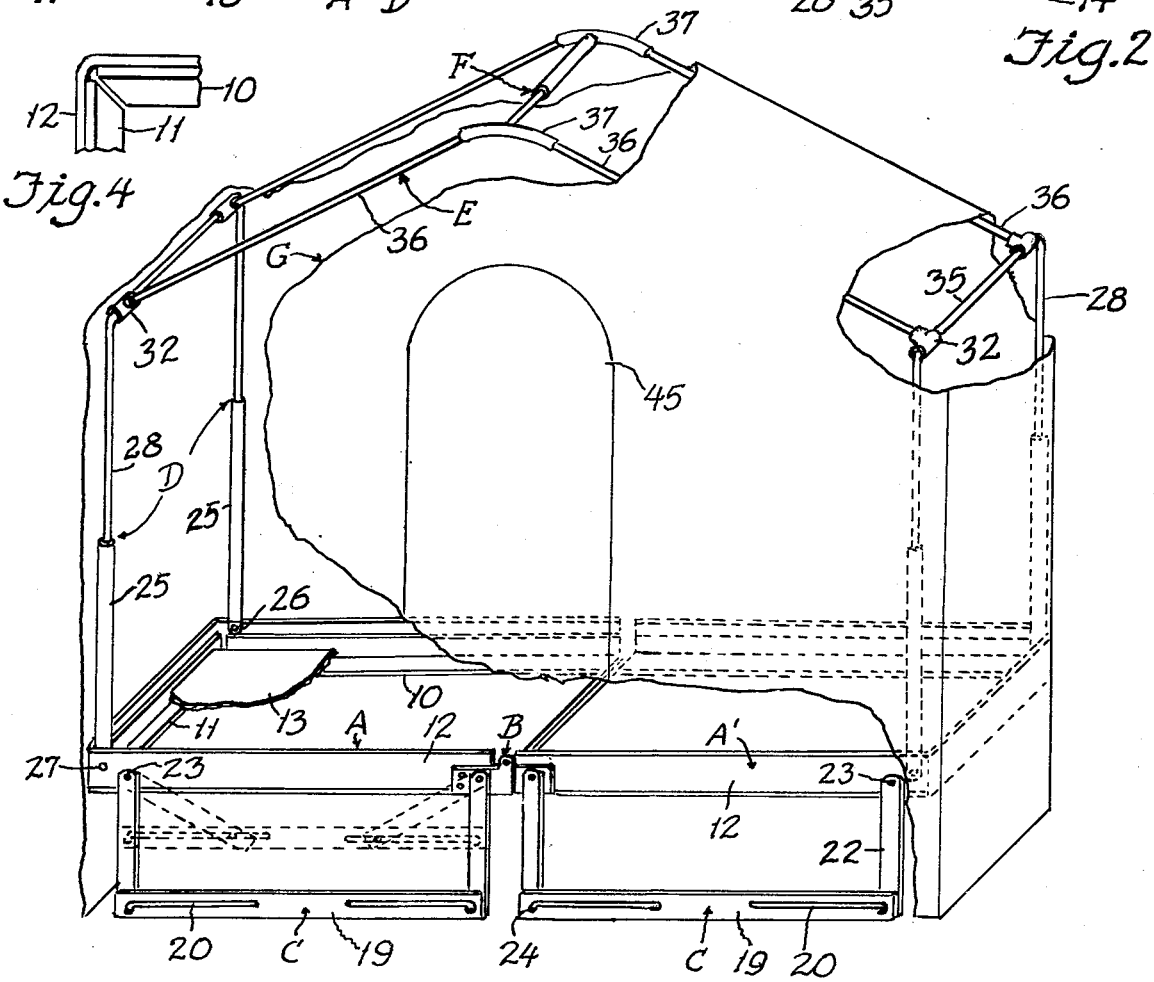
Fig.1

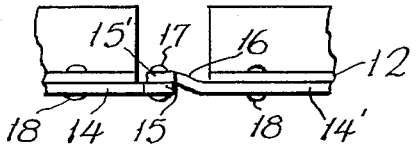
Fig. 5
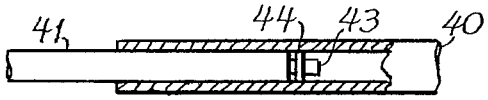
Fig. 7
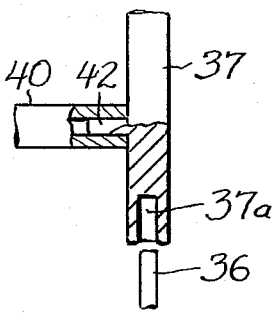
Fig. 8
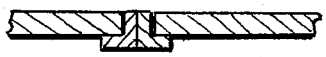
Fig. 9
Fig.6
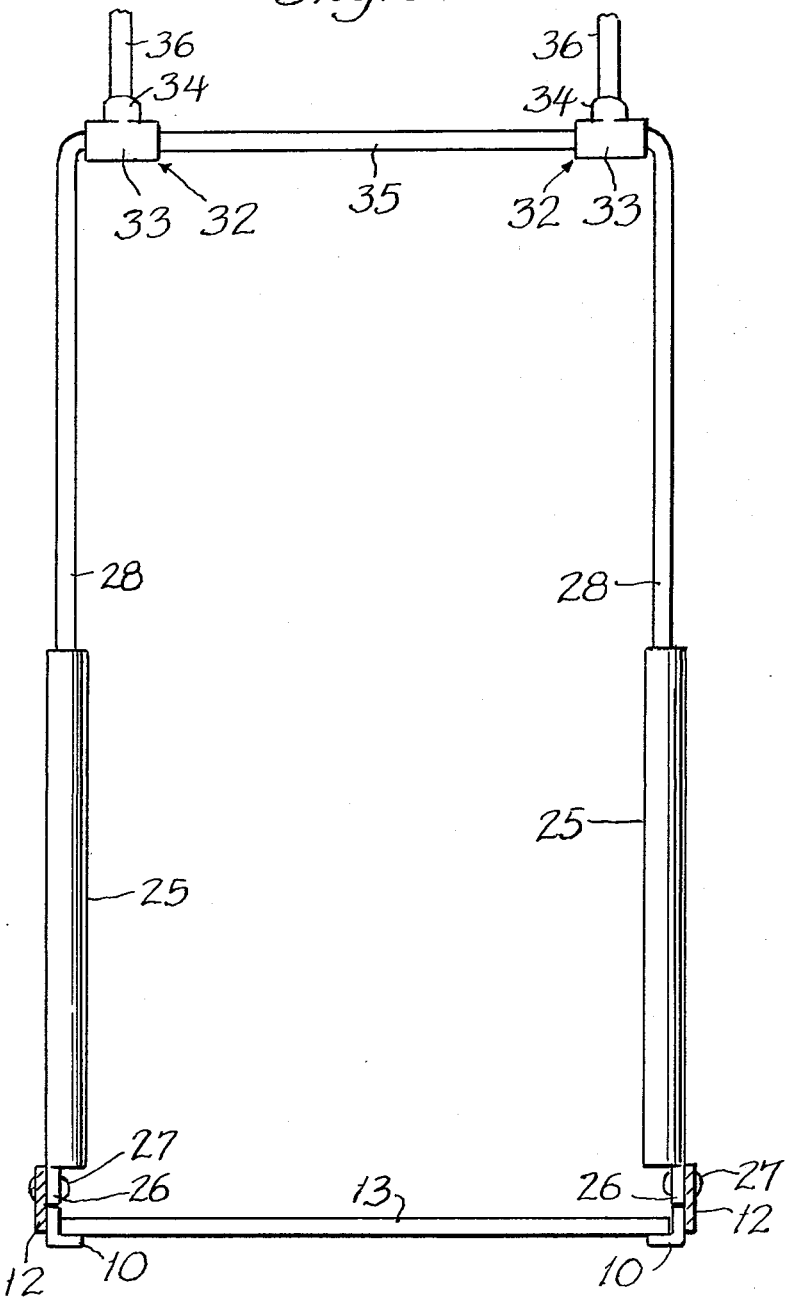
Fig.10
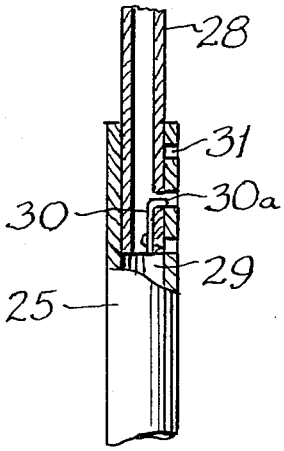

COLLAPSIBLE TENT STRUCTURE WITH ELEVATED FLOOR

CROSS REFERENCE TO RELATED APPLICATION

This application is a continuation in part of application Ser. No. 203,274 filed Nov. 3, 1980 and since abandoned.

OBJECTS OF THE INVENTION

My invention has as its object to provide a frame for a camper's or fisherman's tent, together with a covering of canvas or equivalent sheet material, which will provide a dry and comfortable enclosure in which front, rear and side walls rise vertically with an enclosed living space of maximum comfort and convenience.

IN THE DRAWING

FIG. 1 is an isometric drawing of a collapsible tent structure embodying my invention, with portions of the canvas covering removed to illustrate the internal frame structure;

FIG. 2 is a view of the frame structure in collapsed, folded condition for transport to or from a camping site;

FIG. 3 is a detail front view of portions of the floor supporting structure of the frame mechanism, on a scale larger than that of FIG. 1; FIG. 4 is a detail plan view of a corner portion of one of the floor supporting frames;

FIG. 5 is a detail plan view of one of the hinges which join the two floor frames for folding one upon the other;

FIG. 6 is a vertical view of one of the two foldable side frames, the floor frame to which it is hingedly connected for folding, being shown in cross section;

FIG. 7 is a detail of the adjustable connection between the two sections of the ridge pole structure;

FIG. 8 is a detail of one of the ridge pole connecting yokes:

FIG. 9 is a detail of the abutting floor slab structure;

FIG. 10 is a detail of the corner post coupling sleeve with height adjustment latch mechanism.

DETAILED DESCRIPTION OF THE INVENTION

Figure 11:
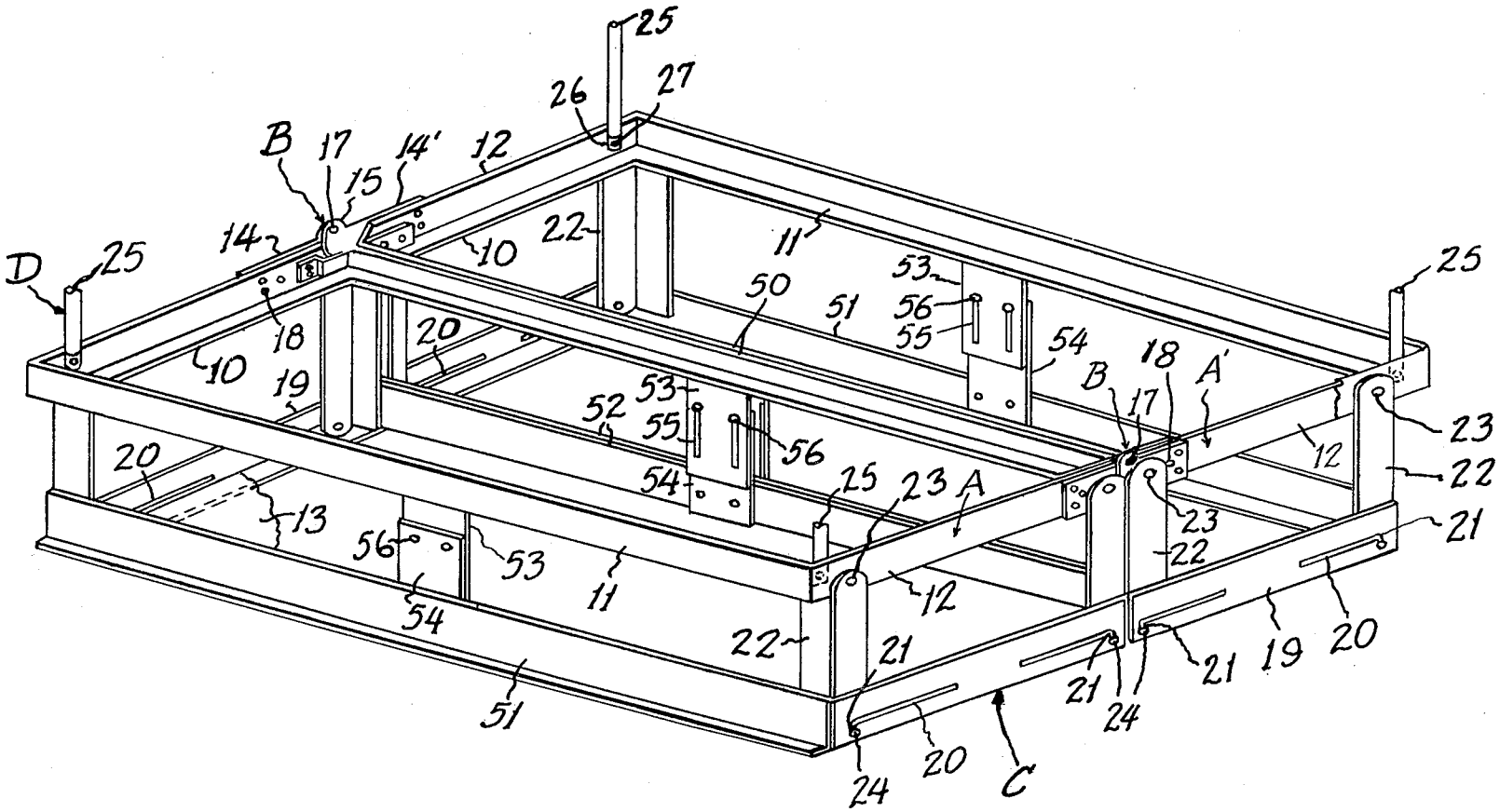
FIG. 11 is an isometric view of a modified form of the floor frame, with the folding of one section thereof shown in broken lines. The showing of FIG. 11 is new in this continuation in part application.

Referring to FIG. 1, the frame structure of my collapsible tent structure may comprise, in general, two floor supporting frames A and A′ hinged together on a medial axis by hinges B; foldable supports C for supporting frames A and A′ at positions substantially elevated above ground level; four upright corner posts D foldably attached to the four corners of floor frames A and A′; four roof bars E detachably coupled at their upper ends to a ridge pole structure F detachably coupled to roof bars E. Portions of a canvas covering G are illustrated, with other areas thereof broken away to illustrate the internal frame structure of the invention.

Floor supporting frames A and A′ each comprise front and rear bars 10 and end bars 11, each of angle bar structure, and a supporting frame 12 of rectangular U form, secured to the vertical outer faces of bars 10 and 11 and providing corners for the respective frames A and A′. A small portion of one of the floor slabs 13 is shown in the far corner of frame A, supported on the horizontal flanges of bars 10 and 11.

Hinges B (FIG. 5) each comprise a pair of L shaped bars each including a relatively wide horizontal bar 14, 14′ and a relatively short vertical bar 15, 15′ rising from one end of a respective bar 14 or 14′. Bar 14′ is offset rearwardly at 16 so that vertical bar 15′ lies behind bar 15 (FIG. 5) and is connected thereto by a hinge rivet 17. Bars 14 and 14′ are attached to adjacent ends of respective frames by rivets 18.

Foldable supports C (FIG. 3) each comprise a ground engaging bar 19 having in its respective end portions longitudinal slots 20 each terminating at its outer end with a downwardly hooked end portion 21. Legs 22 are pivotally attached to supporting frames 12 by means of rivets 23, and at their lower ends are provided with follower rivets 24 which are slidably engaged in slots 20. When supports C are to be folded, rivets 24 are shifted out of downwardly hooked ends of slots 20 and are slid toward one another as legs 22 are folded upwardly as indicated in broken lines in FIG. 1. Legs 22 and bars 19 are then substantially aligned with frames A and A′ in the folded condition shown in FIG. 2. When supports C are in extended positions shown in full lines in FIG. 1, they will support the frame structure in upright position, with floor slabs 13 in horizontal positions, elevated above the ground. Thus the floor will be maintained free of ground moisture. Bedding (not shown) is then arranged on the floor slabs 13, for accomodating comfortable sleeping.

Each corner post D comprises a tubular arm 25 having at its lower end a lip 26 pivotally attached by a rivet 27 to a respective corner of a supporting frame 12, and having an extension arm 28 slidably received in a bore 29 therein. Extension arms 28 are integrally joined at their upper ends by a cross bar 35, the height of which can be varied by changing the extension of arms 28. Arms 28 can be secured in a selected position of upward extension by means of spring latches 30 (FIG. 10) respectively secured in bores in their lower ends, engageable in spaced apertures 31 in tubular arms 25. Each latch 30 has a rounded nose **30*a* adapted to be moved past apertures 31 when force is applied to its carrying arm 28, but operative to support its respective arm 28** in the absence of external force.

Mounted on the cross bar 35 at the upper end of each extension arm 28 is a coupling 32, each including a socket 33 extending horizontally and a socket 34 extending diagonally upwardly when the tent is erected Roof bar structure E comprises four bars 36, inclined upwardly toward ridge pole structure F in the erected tent, each having it lower end secured in a respective diagonal socket 34; and in the ridge pole area F their upper ends are removably coupled in sockets **37*a* of connecting yokes 37 of ridge pole structure F. (FIG. 8**).

Ridge pole structure F includes the connecting yokes 37, which have respective arms curved downwardly to correspond to the inclination of roof bars 36; and respective extension arms 40 and 41, the former being tubular, having a bore in which arm 41 is received at its one end, and at its other end being rotatably coupled to its respective yoke 37 by means of a pin 42 forming part of that yoke. On an integral pin 43 on the end of arm 41 is rotatably mounted a locking disc 44 which is adapted to lock in arm 40 upon rotation of that arm about arm 41. This is made possible by the fact that pin 43 and disc 44 are slightly eccentric with respect to the axis of arm 41.

The canvas covering G has an opening 45 in its front side, providing a door for entry and exit.

In the process of disassembling the erected tent, the ridge pole F is first relaxed by rotating the extension arm 40 on the arm 41 to loosen the grip of locking disc 44 in the bore of arm 40, thus allowing arm 41 to be moved into arm 40 and thereby loosening the covering G. Roof bars 36 may then be withdrawn at their upper ends from yokes 37, making it possible to remove the ridge pole structure F including parts 37, 40 and 41. Frame rods 36 may then be swung downwardly about cross bar 35 to lie in the planes of extension arms 28, and posts D, along with frame rods 36, folded downwardly to lie alongside supporting frames A, A'. Release of latch pins 30 and telescoping of extension rods 28 downwardly into tubular post elements 25 may be effected to whatever extent necessary. Foldable supports C are then folded upwardly as previously described, thus allowing the folding of floor frames A and A', one upon the other, bringing the frame structure to the folded condition shown in FIG. 2 (in which the parts E and F are not shown).

Assembly of the tent is accomplished by reversal of the steps described above.

MODIFIED FORM OF FLOOR SUPPORTING FRAME

Referring now to FIG. 11, the floor frame shown therein is generally the same as the frame structure illustrated in FIG. 1, but embodies the following added features:

Spanning the hinges B and attached at their ends to ends bars 10, are a pair of medial bars 50 bridging between the ends of end bars 10 and acting as braces between hinges B, B.

Bridging between the lower ends of legs 22 are outer and inner brace bars 51 and 52 respectively.

Extending vertically in the opened floor frame are a pair of upper and lower guide plates 53 and 54, one pair being operative between each of a respective outer brace bar and a respective floor bar 11, and the other pairs being operative between respective medial bars 50 and inner brace bars 52. Each pair of guide plates comprises a lower plate 54, secured to and extending upwardly from a brace bar 51 or 52, and an upper plate 53 secured to a floor bar 11 or medial bar 50. In ech pair of guide plates, upper plate 53 is provided with a pair of vertically extending slots 55 in which headed pins 56, anchored in the upper ends of lower plate 54, are slidable vertically to accomodate increase in the spacing between floor bars 11 and brace bars 51 (or between medial bars 50 and brace bars 52) in the folding of the respective floor frames.

I claim as my invention:

1. In a collapsible tent structure, in combination with a floor structure comprising:

means defining said collapsible tent structure supported by a floor structure, said floor structure comprising two substantially rectangular sections each including a frame comprising a pair of parallel side bars joined by a pair of parallel cross bar;

supports for elevation of the respective frames above ground level, each support comprising an elongated leg, each leg being pivotally attached at one end thereof to a respective end of a said side bar, a pair of ground engaging side bars and a pair of ground engaging cross bars, said ground engaging side bars having in respective end portions thereof, longitudinal slots disposed in vertical planes;

and pivotal connections between the other end of each of said legs and said slots, whereby said legs may be folded upwardly into close association with the respective floor structure side bars;

and hinges joining the respective sections to one another for folding one upon the other.

2. A collapsible tent structure as defined in claim 1, wherein the remote ends of said slots are hooked downwardly to retain said pivotal connections in engagement with the ends of said slots.

3. A collapsible tent structure as defined in claim 1, wherein each of said hinges comprises two L-shaped leaves including horizontal legs secured to respective floor sections and upwardly projecting arms pivotally joined to one another.

4. A collapsible tent structure as defined in claim 1, including corner posts each hinged at its lower end to a corner portion of a respective frame for folding downwardly into close association with a respective side arm of said frame.

5. A collapsible tent structure as defined in claim 1, including substantially vertical corner posts each of which is tubular in its upper end portion, and each hinged at its lower end to a corner portion of a respective floor structure for folding downwardly into close association with a respective side bar of said frame; an extension rod telescopically mounted within said tubular upper end portion; and a latch device operable to hold said rod in an upwardly extended position.

6. A collapsible tent structure as defined in claim 1, including substantially vertical corner posts each hinged at its lower end to a corner portion of a respective frame for folding downwardly alongside the respective side bar of said frame; a transverse bar integrally joined to the upper ends of respective posts to form therewith a frame of inverted U-shape; a coupling rotatably mounted on each end of said transverse bar adjacent the upper end of a respective post, each coupling including an upwardly inclined socket; and roof supporting bars releaseably received in respective sockets.

* * * * *